US009061532B2

(12) United States Patent
Nodsu

(10) Patent No.: US 9,061,532 B2
(45) Date of Patent: Jun. 23, 2015

(54) LIQUID-DROPLET EJECTION DEVICE

(71) Applicant: Tomohiro Nodsu, Seto (JP)

(72) Inventor: Tomohiro Nodsu, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 69 days.

(21) Appl. No.: 13/630,827

(22) Filed: Sep. 28, 2012

(65) Prior Publication Data

US 2013/0194335 A1 Aug. 1, 2013

(30) Foreign Application Priority Data

Jan. 31, 2012 (JP) ..... 2012-017646

(51) Int. Cl.

| | |
|---|---|
| ***B41J 29/38*** | (2006.01) |
| ***B41J 2/045*** | (2006.01) |
| ***B41J 2/14*** | (2006.01) |
| ***B41J 2/165*** | (2006.01) |

(52) U.S. Cl.

CPC ..... *B41J 29/38* (2013.01); *B41J 2/0451* (2013.01); *B41J 2/04563* (2013.01); *B41J 2/0458* (2013.01); *B41J 2/1408* (2013.01); *B41J 2/14153* (2013.01); *B41J 2/16579* (2013.01)

(58) Field of Classification Search

CPC ..... B41J 2/365; B41J 2/42
USPC ..... 347/14, 26
See application file for complete search history.

(56) References Cited

U.S. PATENT DOCUMENTS

| | | | | |
|---|---|---|---|---|
| 6,086,180 | A * | 7/2000 | Sugimoto et al. | 347/14 |
| 7,090,323 | B2 * | 8/2006 | Takatsuka | 347/17 |
| 8,162,426 | B2 * | 4/2012 | Suzuki | 347/11 |
| 2011/0211000 | A1 * | 9/2011 | Aoki et al. | 347/9 |

FOREIGN PATENT DOCUMENTS

JP 2008-168565 A 7/2008

* cited by examiner

*Primary Examiner* — Alessandro Amari
*Assistant Examiner* — Michael Konczal
(74) *Attorney, Agent, or Firm* — Scully, Scott, Murphy & Presser, P.C.

(57) ABSTRACT

A printer includes an inkjet head that includes a plurality of individual flow passages each including a nozzle and a manifold commonly communicating with the plurality of individual flow passages, a heater that heats ink in the manifold, and a temperature sensor that detects a temperature of ink in the manifold. After the heater heats ink in the manifold, liquid droplets are ejected from the nozzles of the inkjet head. Abnormal ejection of the nozzle is detected based on a detected change in a temperature of the ink in the manifold.

5 Claims, 11 Drawing Sheets

| NOZZLE (EJECTION AMOUNT) | NOZZLE A (4a) | NOZZLE B (2a) | NOZZLE C (a) | TOTAL EJECTION AMOUNT |
|---|---|---|---|---|
| COMBINATION OF EJECTION AND NON-EJECTION | 1 | 1 | 1 | 7a |
| | 1 | 1 | 0 | 6a |
| | 1 | 0 | 1 | 5a |
| | 1 | 0 | 0 | 4a |
| | 0 | 1 | 1 | 3a |
| | 0 | 1 | 0 | 2a |
| | 0 | 0 | 1 | a |
| | 0 | 0 | 0 | 0 |

(NOTE) NORMAL EJECTION "1", NON-EJECTION "0"

FIG. 7

| NOZZLE (EJECTION AMOUNT) | NOZZLE A (4a) | NOZZLE B (2a) | NOZZLE C (a) | TOTAL EJECTION AMOUNT |
|---|---|---|---|---|
| COMBINATION OF EJECTION AND NON-EJECTION | 1 | 1 | 1 | 7a |
| | 1 | 1 | 0 | 6a |
| | 1 | 0 | 1 | 5a |
| | 1 | 0 | 0 | 4a |
| | 0 | 1 | 1 | 3a |
| | 0 | 1 | 0 | 2a |
| | 0 | 0 | 1 | a |
| | 0 | 0 | 0 | 0 |

(NOTE) NORMAL EJECTION "1", NON-EJECTION "0"

FIG. 10B

| LEFT NOZZLE ARRAY | | RIGHT NOZZLE ARRAY | |
|---|---|---|---|
| No. | EJECTION ORDER | No. | EJECTION ORDER |
| 1 | 1 | 1 | 2 |
| 2 | 4 | 2 | 3 |
| 3 | 1 | 3 | 2 |
| 4 | 4 | 4 | 3 |
| 5 | 1 | 5 | 2 |
| 6 | 4 | 6 | 3 |
| 7 | 2 | 7 | 1 |
| 8 | 3 | 8 | 4 |
| 9 | 2 | 9 | 1 |
| 10 | 3 | 10 | 4 |
| 11 | 2 | 11 | 1 |
| 12 | 3 | 12 | 4 |

LIQUID-DROPLET EJECTION DEVICE

CROSS-REFERENCE TO RELATED APPLICATIONS

This non-provisional application claims priority under 35 U.S.C. §119(a) on Patent Application No. 2012-017646 filed in Japan on Jan. 31, 2012, the entire contents of which are hereby incorporated by reference.

TECHNICAL FIELD

The present invention relates to a liquid-droplet ejection device that ejects a liquid droplet.

BACKGROUND

In fields using a liquid-droplet ejection device such as an inkjet printer, a liquid droplet may not be ejected normally from a nozzle and abnormal ejection thus occurs when dust, bubbles, or the like is mixed in a flow passage including a nozzle during use of the liquid-droplet ejection device. When the abnormal ejection occurs, an amount of a liquid droplet ejected from a nozzle may decrease or a liquid droplet may not be ejected from a nozzle. Accordingly, conventionally devices capable of detecting whether abnormal ejection occurs in a plurality of nozzles have been suggested.

Japanese Patent Application Laid-Open No. 2008-168565 discloses an inkjet head that ejects a liquid droplet of ink. The inkjet head includes a plurality of nozzles, a plurality of pressure generation chambers communicating with the plurality of nozzles respectively, and a plurality of piezoelectric elements applying a pressure to ink stored in the plurality of pressure generation chambers. Each of the plurality of pressure generation chambers is provided with a heating element that heatsink stored in each pressure generation chamber and a temperature sensor that detects the temperature of the ink.

To detect abnormal ejection of a nozzle, ink is ejected from the nozzle communicating with the pressure generation chamber while the heating element heatsink stored in each pressure generation chamber. At this time, when a liquid droplet is normally ejected from the nozzle, a temperature of the ink stored in the pressure generation chamber gently increases due to the fact that the ink flows in the pressure generation chamber. However, when the abnormal ejection occurs in the nozzle, a temperature of the ink in the pressure generation chamber sharply increases due to the fact that the ink flows less in the pressure generation chamber. Accordingly, based on a change in a temperature of ink in the pressure generation chamber detected by a temperature sensor, it can be detected whether abnormal ejection occurs in a nozzle.

SUMMARY

As disclosed in Japanese Patent Application Laid-Open No. 2008-168565, the heating element and the temperature sensor are individually arranged in each of the plurality of pressure generation chambers communicating with the plurality of nozzles. Therefore, as the number of nozzles increases, the number of heating elements and the number of temperature sensors increase, and thus the number of wirings connected to the heating elements and the temperature sensors also increases. For this reason, since the configuration becomes complicated due to the increase in the number of components, it is difficult to ensure spaces for drawing the wirings. Further, an increase in cost is caused due to the increase in the number of components.

In order to resolve such problems, an object is to provide a liquid droplet device in which the configuration of a heater necessary to detect abnormal ejection of a nozzle can be simplified.

The liquid-droplet ejection device according to a first aspect is a liquid-droplet ejection device comprising: a liquid-droplet ejection head that includes a plurality of individual flow passages each provided with a nozzle and a common flow passage commonly communicating with the plurality of individual flow passages; a heater that is provided in the common flow passage and heats liquid in the common flow passage; a temperature sensor that is provided in the common flow passage and detects a temperature of liquid in the common flow passage; and an control section that causes the liquid-droplet ejection head to eject a liquid droplet from the nozzle of the liquid-droplet ejection head while or after the heater heats liquid in the common flow passage, wherein the control section detects a change in a temperature of liquid in the common flow passage detected by the temperature sensor when the control section causes the liquid-droplet ejection head to eject a liquid droplet from the nozzle of the liquid-droplet ejection head.

According to the first aspect, the control section causes the liquid-droplet ejection head to eject a liquid droplet from a nozzle to be examined to detect whether abnormal ejection occurs, while or after the heater heats liquid in the common flow passage. When the liquid droplet is normally ejected from the nozzle, the liquid is supplied from the common flow passage to the individual flow passages, and then a new liquid is supplied to the common flow passage from the upstream side as the liquid is supplied. However, when abnormal ejection occurs in the nozzle, liquid is scarcely supplied from the upstream side. Therefore, a change in a temperature of liquid in the common flow passage is different depending on whether a liquid droplet is ejected from the nozzle normally or abnormally. Accordingly, abnormal ejection of a nozzle can be detected based on a change in a temperature of liquid in the common flow passage when a liquid droplet is ejected. Further, according to the first aspect, the heater heats the liquid in the common flow passage commonly communicating with the plurality of individual flow passages, and the temperature sensor detects a temperature of liquid in the common flow passage when the control section causes the liquid-droplet ejection head to eject a liquid droplet from a nozzle. In this configuration, since the heater and the temperature sensor are arranged in the common flow passage, the number of heaters and the number of temperature sensors are smaller and the wirings are easily drawn, compared to the configuration in which the heater and the temperature sensor are arranged in each of the plurality of individual flow passages.

According to the first aspect, the heater heats liquid in the common flow passage commonly communicating with the plurality of nozzles, and the temperature sensor detects a temperature of the liquid in the common flow passage when a liquid droplet is ejected from a nozzle. In this configuration, since the heater and the temperature sensor are arranged in the common flow passage, the numbers of heaters and temperature sensors are smaller and the wirings are easily drawn, compared to the configuration in which the heater and the temperature sensor are arranged in each of the plurality of individual flow passages.

The above and further objects and features will more fully be apparent from the following detailed description with accompanying drawings.

BRIEF DESCRIPTION OF THE SEVERAL VIEWS OF THE DRAWINGS

FIG. 7 is a diagram illustrating a combination of normal ejection and non-ejection when liquid droplets are ejected from three nozzles.

FIGS. 10A and 10B are diagrams illustrating a specific example of an ejection order of a plurality of nozzles of a nozzle array.

DETAILED DESCRIPTION

Figure 1:
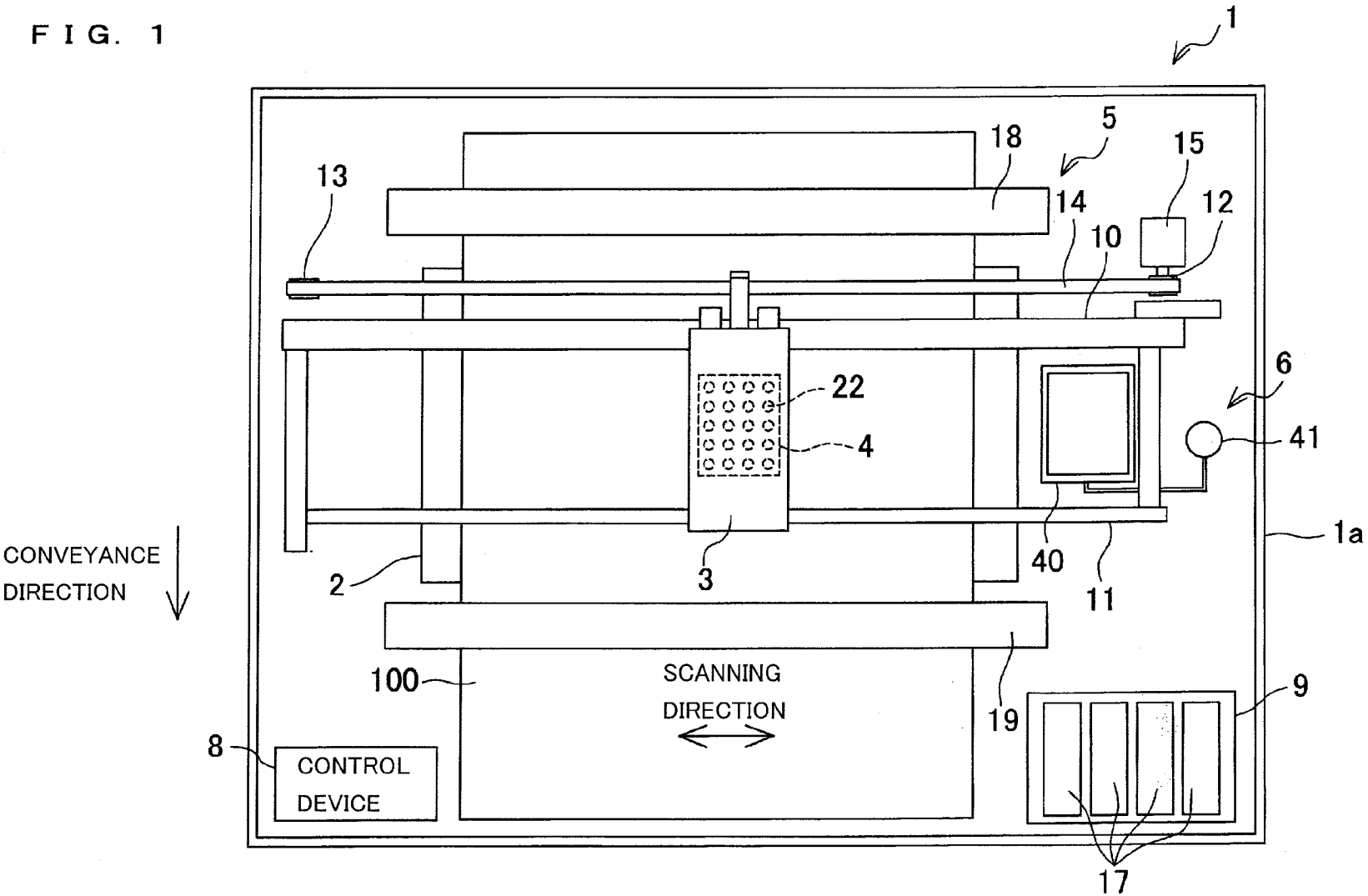
FIG. 1 is a schematic plan view illustrating an inkjet printer according to an embodiment.

Next, an embodiment will be described. FIG. 1 is a schematic plan view illustrating an inkjet printer 1 according to the embodiment. First, an overall configuration of the inkjet printer 1 will be described with reference to FIG. 1. Hereinafter, the front side of the sheet surface in FIG. 1 is defined as an upper side and the side opposite to the sheet surface is defined as a lower side, and the terms "upper" and "lower" are appropriately used for description. As shown in FIG. 1, the inkjet printer 1 comprises a platen 2, a carriage 3, an inkjet head 4, a conveyance mechanism 5, a purge mechanism 6, and a control device 8.

A recording sheet 100 which is a recording medium is placed on an upper surface of the platen 2. Two guide rails 10 and 11 extending in parallel in the right and left directions (scanning direction) of FIG. 1 are arranged over the platen 2. The carriage 3 is configured to reciprocate along the two guide rails 10 and 11 in the scanning direction in a region opposing the platen 2. Further, an endless belt 14 wound between two pulleys 12 and 13 is connected to the carriage 3. Therefore, when the endless belt 14 is driven to travel by a carriage drive motor 15, the carriage 3 moves in the scanning direction with the travel of the endless belt 14.

The inkjet head 4 is mounted on the carriage 3 so as to move in the scanning direction together with the carriage 3. A lower surface (surface opposite to the sheet surface in FIG. 1) of the inkjet head 4 is configured as a liquid-droplet ejection surface in which a plurality of nozzles 22 are formed. As shown in FIG. 1, a holder 9 is arranged in a printer body 1*a* of the inkjet printer 1. Four ink cartridges 17 that store ink of four colors, black, yellow, cyan, and magenta, respectively, are mounted on the holder 9. Although not shown, the inkjet head 4 mounted on the carriage 3 and the holder 9 are connected to each other by four tubes (not shown). The ink of four colors in the four ink cartridges 17 is supplied to the inkjet head 4 via the four tubes. The inkjet head 4 ejects the ink of four colors toward a recording sheet 100 placed on the platen 2 from the plurality of nozzles 22.

The conveyance mechanism 5 includes two conveyance rollers 18 and 19 disposed in the conveyance direction with the platen 2 interposed therebetween. The two conveyance rollers 18 and 19 are rotatably driven by a conveyance motor 16 (see FIG. 5). The conveyance mechanism 5 causes the two conveyance rollers 18 and 19 to convey a recording sheet 100 placed on the platen 2 in the conveyance direction.

The inkjet printer 1 causes the inkjet head 4 to eject ink toward a recording sheet 100 placed on the platen 2 while reciprocating in the scanning direction together with the carriage 3. The two conveyance rollers 18 and 19 convey the recording sheet 100 in the conveyance direction while the ink is ejected. An image, a character, or the like is recorded on the recording sheet 100 through such operations.

The purge mechanism 6 is a mechanism that recovers the ejection performance of the nozzles 22 by ejecting ink from the plurality of nozzles 22 when abnormal ejection occurs in the nozzles 22 of the inkjet head 4. The purge mechanism 6 is disposed at a location in the outside (the right side in FIG. 1) of a region opposing a recording sheet 100 in a movement range of the carriage 3 in the scanning direction. The purge mechanism 6 includes a cap 40, a suction pump 41 which is connected to the cap 40, and a cap drive motor 42 (see FIG. 5) that moves the cap 40 in the upper and lower directions. The cap 40 is driven in the upper and lower directions (the vertical direction with respect to the sheet surface of FIG. 1) by the cap drive motor 42. By moving the cap 40 upward when the carriage 3 opposes the cap 40, the plurality of nozzles 22 formed in the lower surface of the inkjet head 4 are covered with the cap 40.

By operating the suction pump 41 and depressurizing the inside of the cap 40 when the plurality of nozzles 22 of the inkjet head 4 are covered with the cap 40, suction purging of sucking ink from the plurality of nozzles 22 is performed. Since dust, bubbles, or the dried and thickened ink in the inkjet head 4 is discharged from the plurality of nozzles 22 through the suction purging, the ejection performance of the nozzles 22 in which abnormal ejection has occurred is consequently recovered.

Figure 2:
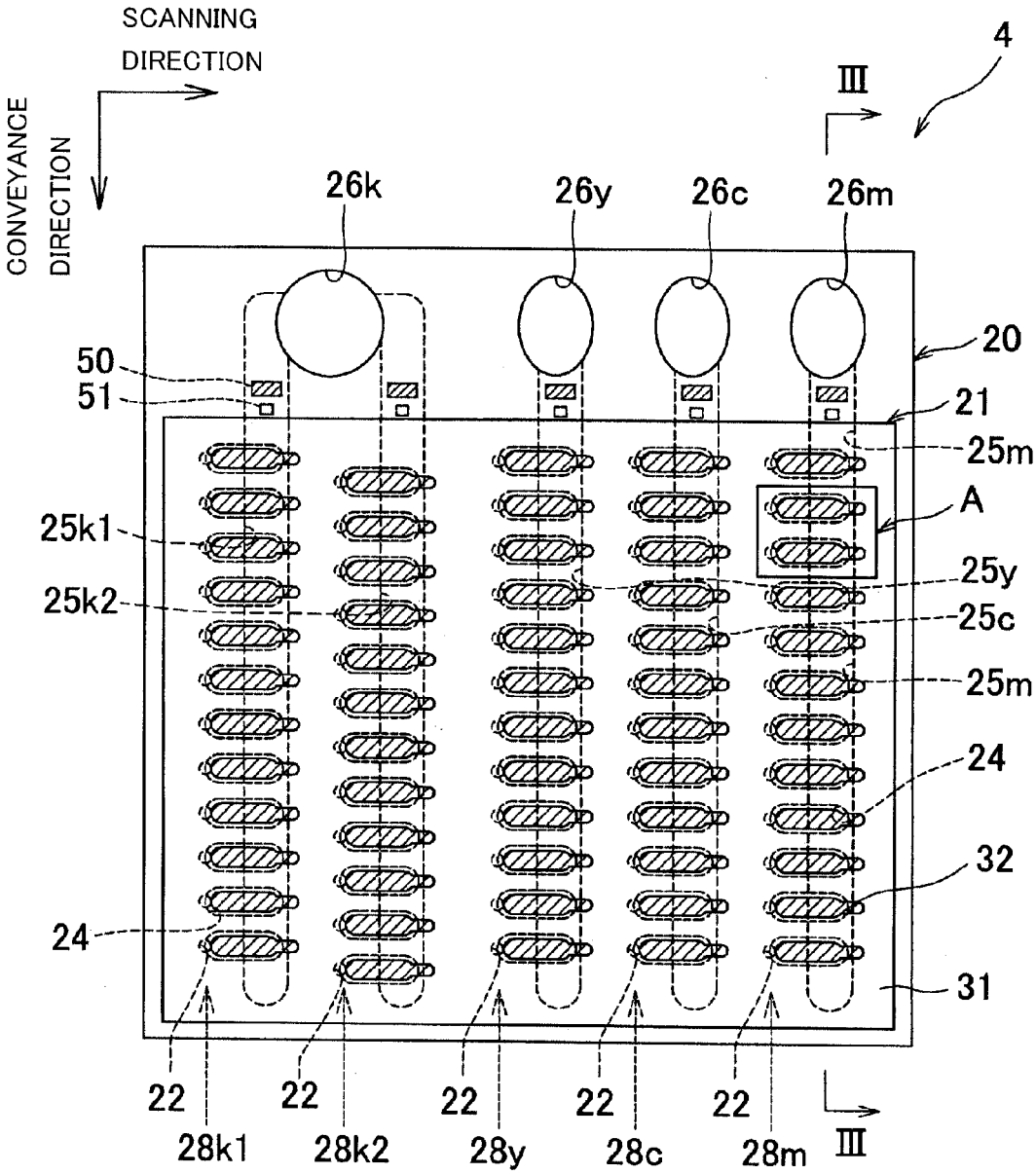
FIG. 2 is a plan view illustrating an inkjet head.
Figure 3:
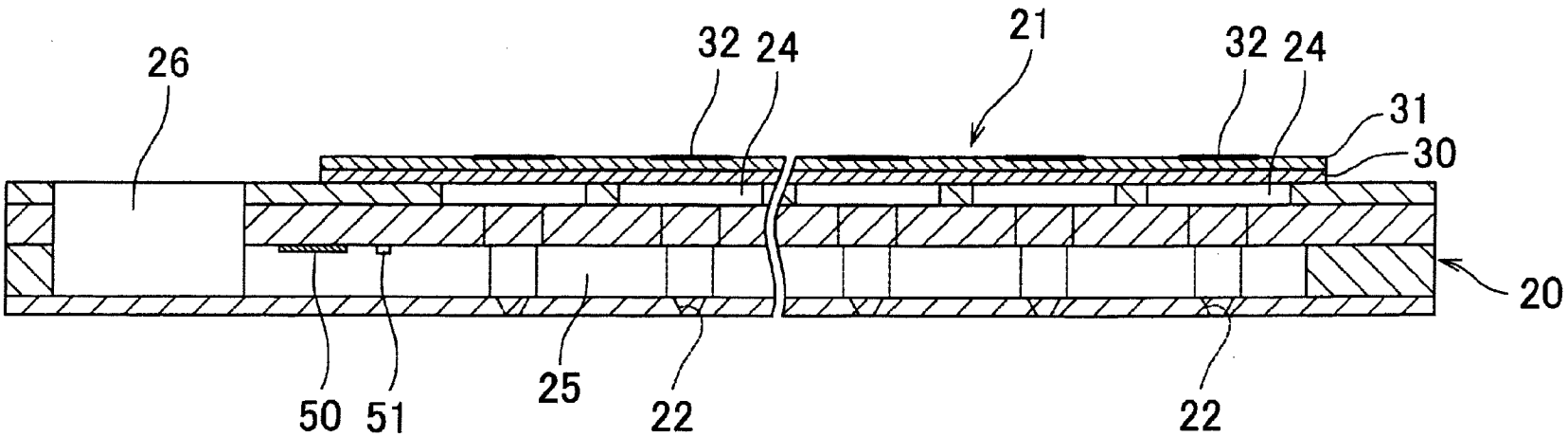
FIG. 3 is a sectional view taken along line III-III of FIG. 2.
Figure 4A:
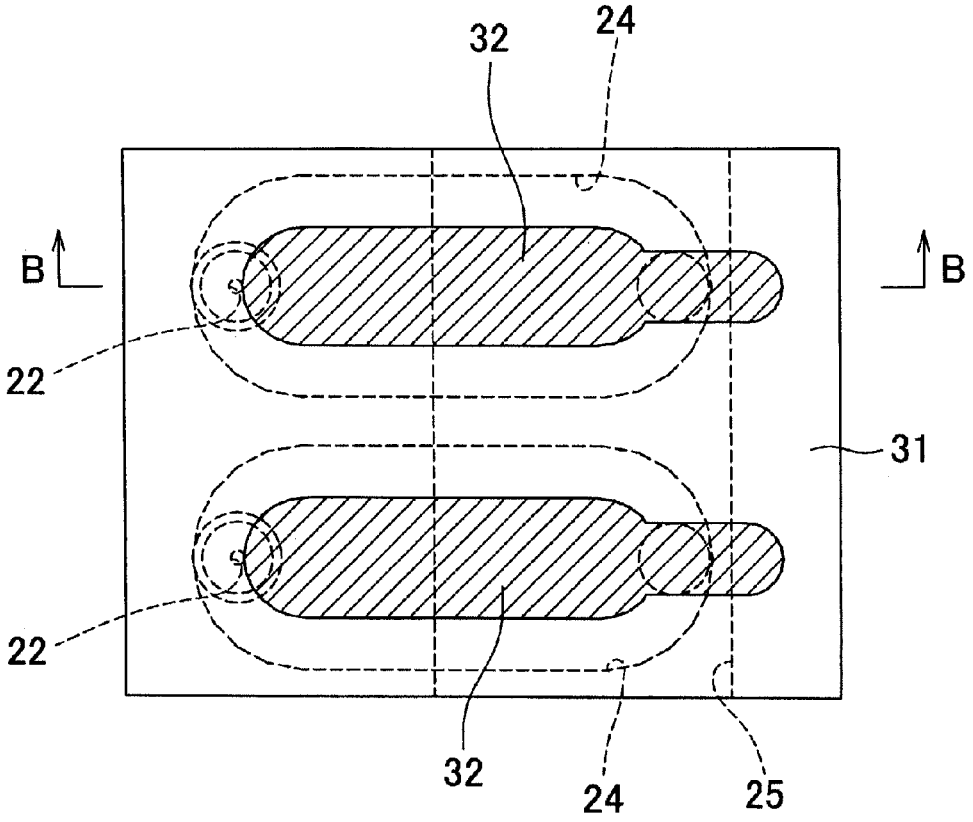
FIG. 4A is an enlarged view illustrating a portion A of FIG. 2.
Figure 4B:
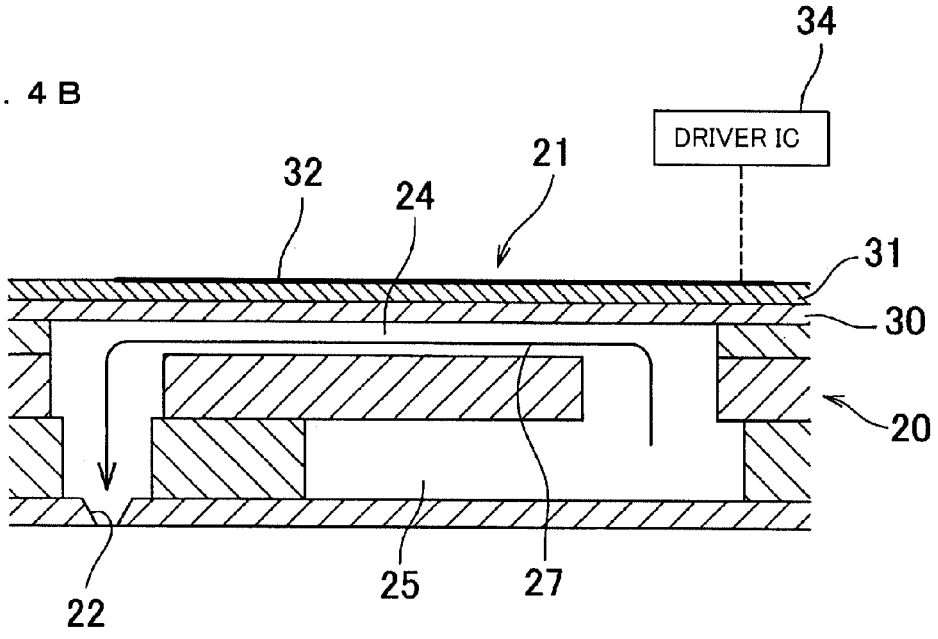
FIG. 4B is a sectional view taken along line B-B of FIG. 4A.

Next, the inkjet head 4 will be described. FIG. 2 is a plan view illustrating the inkjet head 4. FIG. 3 is a sectional view taken along line III-III of FIG. 2. FIG. 4A is an enlarged view illustrating an A portion of FIG. 2. FIG. 4B is a sectional view taken along line B-B of FIG. 4A. As shown in FIGS. 2, 3, 4A, and 4B, the inkjet head 4 includes a flow passage unit 20, in which the plurality of nozzles 22 and a plurality of pressure chambers 24 are formed, and a piezoelectric actuator 21 disposed on an upper surface of the flow passage unit 20.

As shown in FIG. 3, the flow passage unit 20 has a structure in which four plates are laminated. In the upper surface of the flow passage unit 20, four ink supply holes 26 are arranged in parallel in the scanning direction. An ink supply hole 26*k* at the left end of FIG. 2 is connected to the ink cartridge 17 for black ink. The other ink supply holes 26*y*, 26*c*, and 26*m* are connected to the ink cartridges 17 for color ink of three colors, yellow, cyan, and magenta, respectively. Further, the ink supply hole 26*k* for black ink is larger than the ink supply holes 26*y*, 26*c*, and 26*m* for color ink.

The flow passage unit 20 includes five manifolds 25 extending in the conveyance direction therein. Further, among the five manifolds 25, two manifolds 25*k*1 and 25*k*2 located on the left of FIG. 2 are connected to the ink supply hole 26*k*, and therefore the black ink is supplied to the manifolds 25*k*1 and 25*k*2. The three other manifolds 25*y*, 25*c*, and

25*m* are connected to the three ink supply holes 26*y*, 26*c*, and 26*m*, respectively, and therefore the color ink of the three colors, yellow, cyan, and magenta, is supplied to the manifolds 25*y*, 25*c*, and 25*m*.

The flow passage unit 20 includes the plurality of nozzles 22 formed on a lower surface thereof and the plurality of pressure chambers 24 communicating with the plurality of nozzles 22, respectively. As shown in FIG. 2, the plurality of nozzles 22 are arranged in five rows to correspond to the five manifolds 25 in a plan view. That is, the plurality of nozzles 22 of the flow passage unit 20 are configured such that two nozzle arrays 28*k*1 and 28*k*2 are formed to eject the black ink and three nozzle arrays 28*y*, 28*c*, and 28*m* are formed to eject the ink of the three colors. The plurality of pressure chambers 24 are also arranged in five rows to correspond to the five manifolds 25, as in the plurality of nozzles 22. As shown in FIG. 4B, the pressure chambers 24 communicate with the corresponding manifolds 25, respectively. Thus, a plurality of individual flow passages 27 are configured in the flow passage unit 20 such that each individual flow passage 27 is diverged from the manifold 25 and includes the pressure chamber 24 and the nozzle 22.

As shown in FIGS. 2 and 3, a heater 50 that heatsink in the manifold 25 and a temperature sensor 51 that detects a temperature of ink in the manifold 25 are arranged in the vicinity of a connection portion between each manifold 25 and the ink supply hole 26, the connection portion being located on the upstream side from a communication portion in which each manifold 25 communicates with the pressure chamber 24. The temperature sensor 51 is located on the downstream side of the manifold 25 from the heater 50. A heater drive circuit 52 (see FIG. 5) that supplies a current to the heater 50 to generate heat is connected to the heater 50. As will be described below, each heater 50 and each temperature sensor 51 are used to detect abnormal ejection of the plurality of nozzles 22 communicating with the corresponding manifold 25.

As shown in FIGS. 3, 4A, and 4B, the piezoelectric actuator 21 includes a vibration plate 30 that covers the plurality of pressure chambers 24, a piezoelectric layer 31 that is disposed on an upper surface of the vibration plate 30, and a plurality of individual electrodes 32 corresponding to the plurality of pressure chambers 24. The plurality of individual electrodes 32 are connected to a driver IC 34 (see FIG. 5) that drives the piezoelectric actuator 21. Further, the vibration plate 30 is made of a metal material and serves as a common electrode that faces the plurality of individual electrodes 32 with the piezoelectric layer 31 interposed therebetween. The vibration plate 30 is connected to a ground wiring of the driver IC 34, and thus is usually maintained with a ground potential. A part of the piezoelectric layer 31 interposed between the vibration plate 30 and the individual electrodes 32 is polarized in the thickness direction thereof.

An operation of the piezoelectric actuator 21 performed when ink is ejected from the nozzles 22 is as follows. That is, when a drive signal is selectively applied from the driver IC 34 to the plurality of individual electrodes 32, a potential difference is formed between the individual electrodes 32 on an upper side of the piezoelectric layer 31 and the vibration plate 30 maintained with the ground potential and serving as the common electrode on a lower side of the piezoelectric layer 31. The potential difference results in generation of an electric field in a portion interposed between the individual electrodes 32 and the vibration plate 30 in the thickness direction. At this time, to match the polarization direction of the piezoelectric layer 31 with the direction of the electric field, the piezoelectric layer 31 extends in the thickness direction, which is the polarization direction, and is contracted in a surface direction. With the contraction deformation of the piezoelectric layer 31, a portion facing the pressure chamber 24 of the vibration plate 30 is bent in a convex shape toward the pressure chamber 24. This is generally called unimorph deformation. At this time, a decrease in the volume of the pressure chamber 24 results in application of a pressure to ink in the pressure chamber, and thus a liquid droplet of the ink is ejected from the nozzle 22 communicating with the pressure chamber 24.

Figure 5:
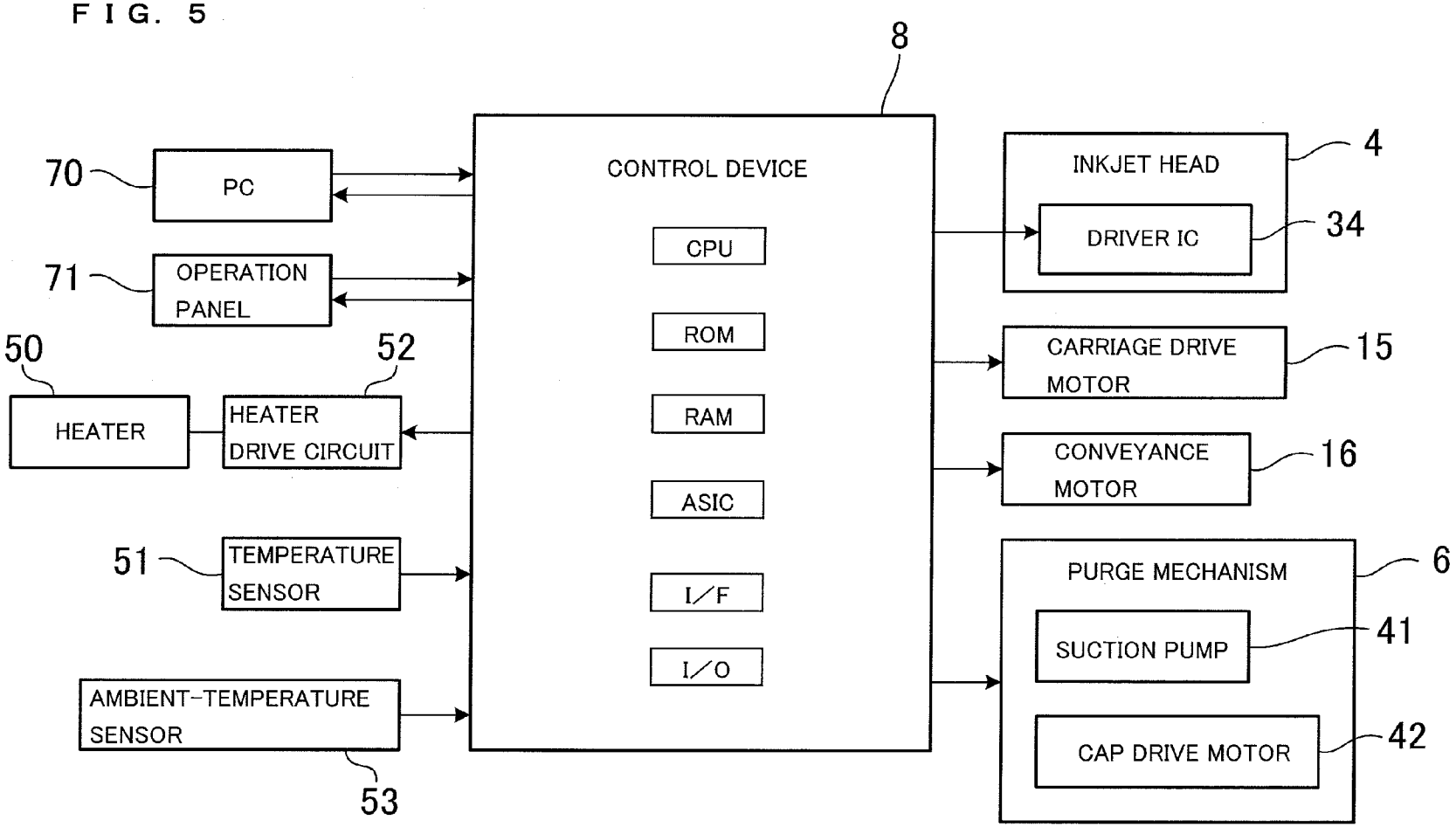
FIG. 5 is a block diagram schematically illustrating an electric configuration of the inkjet printer.

Next, the electric configuration of the inkjet printer 1 will be described focusing on the control device 8. FIG. 5 is a block diagram schematically illustrating the overall electric configuration of the inkjet printer 1. As shown in FIG. 5, the control device 8 (control section) of the inkjet printer 1 includes a central processing unit (CPU), a read-only memory (ROM) that stores various programs or various kinds of data used to control all of the operations of the inkjet printer 1, a random access memory (RAM, including a nonvolatile RAM) temporarily storing data or the like processed by the CPU, an ASIC (Application Specific Integrated Circuit), an I/F (interface) transmitting and receiving data to and from an external device (PC 70 etc.), and an I/O (input/output port) inputting and outputting a signal of various sensors etc., and the like.

When the various programs stored in the ROM are executed by the CPU, the control device 8 controls respective components of the inkjet printer 1 via the ASIC. The PC 70 which is the external device and an operation panel 71 including a display and an operational button etc. are connected to the control device 8. Further, the control device 8 is supplied with a signal of the temperature sensor 51 arranged in each manifold 25 of the inkjet head 4 and a signal of an ambient-temperature sensor 53 that detects an ambient temperature around the inkjet head 4.

The control device 8 controls the driver IC 34 of the inkjet head 4, the carriage drive motor 15, and the conveyance motor 16 of the conveyance mechanism 5 based on data regarding an image or the like inputted from the PC 70.

The control device 8 detects whether abnormal ejection occurs in each of the plurality of nozzles 22. As will described in detail below, the control device 8 detects abnormal ejection of each nozzle 22 using the heater 50 and the temperature sensor 51 arranged in each manifold 25. The control device 8 controls the cap drive motor 42 and the suction pump 41 of the purge mechanism 6 to perform the suction purging of the inkjet head 4.

Next, detection of abnormal ejection of the nozzle 22 by the control device 8 will be described. In some cases, no ink droplet is ejected from the nozzle 22, since dust or bubbles flow into the inkjet head 4 from the ink cartridge 17 on the upstream side or ink is dried in an opening of the nozzle 22. Therefore, the control device 8 detects whether abnormal ejection occurs in each nozzle 22. In this embodiment, a non-ejection state in which no liquid droplet is ejected from the nozzle 22 is assumed as abnormal ejection of the nozzle 22. Therefore, the control device 8 detects whether non-ejection occurs in the nozzle 22.

A non-ejection detection timing is not particularly limited, but the non-ejection detection can be performed at any timing. However, a higher effect can be achieved when there is a high probability that non-ejection occurs. For example, when a recording operation of ejecting ink from the inkjet head 4 is not performed for a while in the inkjet printer 1, there is a high probability that bubbles may be mixed in or ink may be dried. Accordingly, abnormal ejection detection may be performed when a given time elapses after power supply to the inkjet printer 1 or a previous recording operation. Alternatively, the abnormal ejection detection may be started when a user's instruction to perform the non-ejection detection is input from the PC 70 or the operation panel 71.

An overview of the abnormal ejection detection according to this embodiment will be described. First, the heater 50 heatsink in the manifold 25 communicating with the nozzle 22 to be examined up to a predetermined target temperature. After the heating, the control device 8 controls the driver IC 34 such that a liquid droplet is ejected from the nozzle 22 to be examined. When the ejection is normal in the nozzle 22, the ink is supplied to the individual flow passage 27 from the manifold 25 in accordance with the ejection of the ink, and thus the ink flows in the manifold 25. Simultaneously, the ink with low temperature is supplied from the ink cartridge 17 on the upstream side to the manifold 25. Conversely, when non-ejection occurs in the nozzle 22, the ink scarcely flows in the manifold 25, and thus the ink is not supplied from the upstream side. Accordingly, the extent of a change in a temperature of the ink in the manifold 25 is different between when the ejection is normally performed in the nozzle 22 and when the non-ejection occurs in the nozzle 22. Therefore, the temperature sensor 51 detects a temperature of ink in the manifold 25 when the control device 8 causes the inkjet head 4 to eject a liquid droplet from the nozzle 22. Then, the control device 8 detects a change in the temperature of the ink based on the detected temperature of the ink and determines whether non-ejection occurs in the nozzle 22 based on the detected change in the temperature of the ink.

Figure 6:
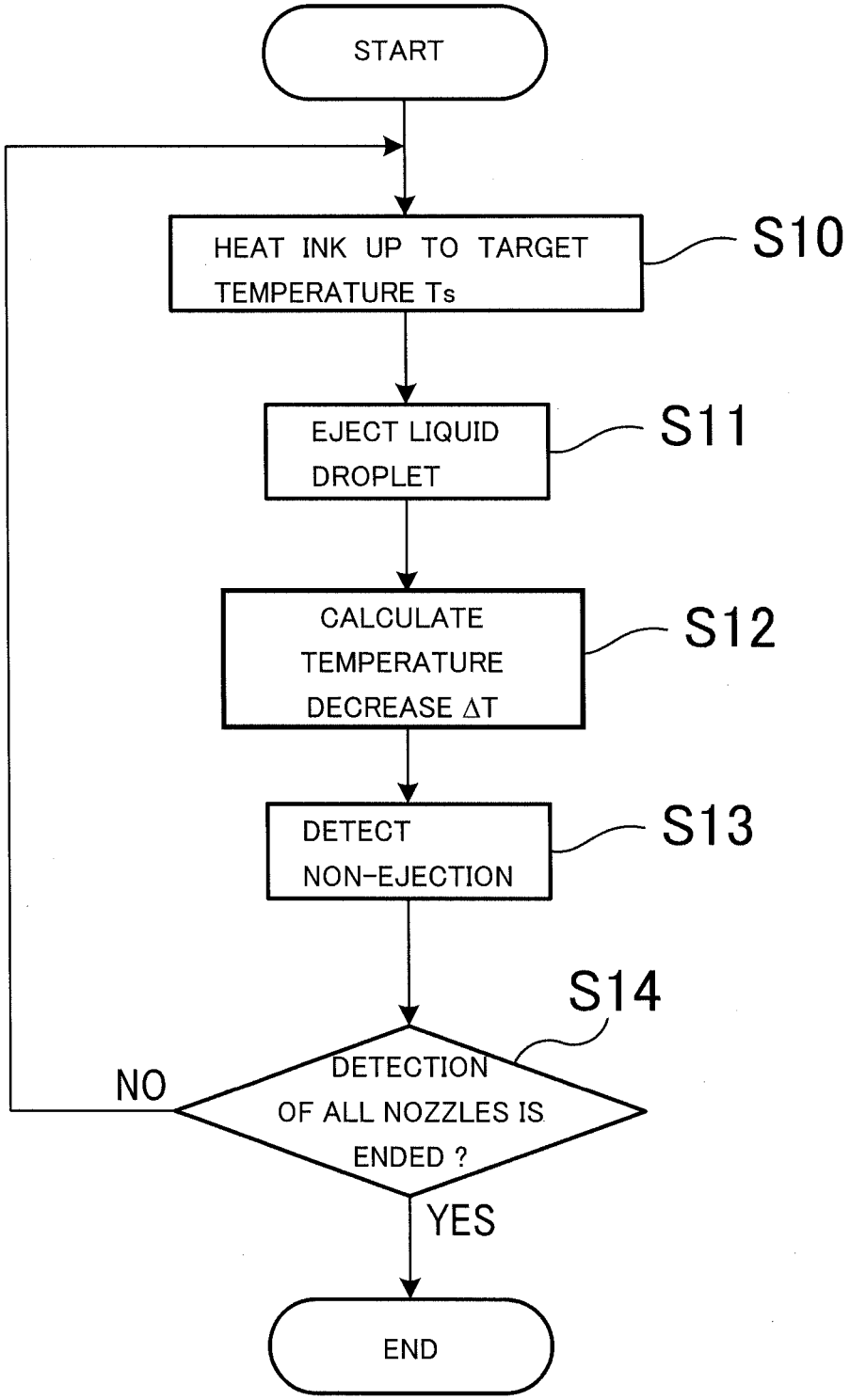
FIG. 6 is a flowchart illustrating detection of ejection abnormality.

A series of operations of the control device 8 that detects abnormal ejection will be described in detail with reference to the flowchart of FIG. 6. In FIG. 6, Si (where i=10, 11, 12, and so on) denotes each step.

First, the control device 8 controls the heater drive circuit 52 and causes the heater 50 to heat ink in the manifold 25 communicating with the nozzle 22 to be examined up to a predetermined target temperature Ts (S10). After the heating, the control device 8 controls the driver IC 34 such that a predetermined amount of a liquid droplet is ejected from the nozzle 22 to be examined (S11). Next, after the control device 8 causes the inkjet head 4 to eject the liquid droplet from the nozzle 22, the temperature sensor 51 detects a temperature of the ink in the manifold 25, and the control device 8 compares the detected temperature of the ink to the predetermined target temperature Ts and calculates a temperature decrease ΔT of the ink from the target temperature Ts (S12). When no liquid droplet is ejected from the nozzle 22, the ink scarcely flows in the manifold 25 and the temperature decrease ΔT of the ink is a small value. Thus, the control device 8 determines whether the calculated temperature decrease ΔT of the ink is less than a predetermined threshold. When the control device 8 determines that the temperature decrease ΔT of the ink is less than the predetermined threshold, the control device 8 detects that non-ejection occurs in the nozzle 22 and outputs a predetermined signal indicating the non-ejection of the nozzle 22 (S13).

Further, in S11, a liquid droplet can be ejected from only one nozzle 22 of one nozzle array 28 communicating with the manifold 25 and non-ejection detection can be performed on each nozzle 22. However, when a liquid droplet is ejected from only one nozzle 22, an amount of consumed ink is small. Therefore, since a temperature decrease of ink in the manifold 25 is also small, it is difficult to perform the non-ejection detection with high accuracy. Furthermore, when the large number of nozzles 22 are provided and the non-ejection detection is performed on the large number of nozzles 22 one by one, it takes much time to complete the non-ejection detection on all the nozzles 22. Accordingly, in this embodiment, after the heater 50 heatsink, the control device 8 does not cause the inkjet head 4 to eject a liquid droplet from only one nozzle 22, but causes the inkjet head 4 to eject liquid droplets from two or more nozzles 22. However, the control device 8 sets amounts of ink ejected from two or more nozzles 22 to be different from each other, so that the control device 8 distinctively detects in which nozzle the non-ejection occurs among two or more nozzles 22.

The non-ejection detection of the nozzles 22 will be described in detail. A case in which it is individually detected whether non-ejection occurs in each of three nozzles 22 when the control device 8 causes the inkjet head 4 to eject liquid droplets from the three nozzles 22 will be exemplified below. The control device 8 sets the amounts of ink ejected from three nozzles 22 to be different from each other, and controls the driver IC 34 of the inkjet head 4 such that liquid droplets are ejected from the three nozzles 22. As a specific method of setting amounts of ink ejected from three nozzles 22 to be different from each other, for example, a method of setting the numbers of times ink is ejected from the three nozzles 22 within a predetermined ejection period to be different from each other can be used. Alternatively, a method of setting the volumes of liquid droplets ejected from three nozzles 22 when the ejection operation is performed once to be different from each other may be used. Thus, when amounts of ink ejected from three nozzles 22 are set to be different from each other, a change in a temperature of ink in the manifold 25 is different depending on which nozzle ejects no ink among the nozzles 22.

When the control device 8 causes the inkjet head 4 to eject a liquid droplet from each of n (where n is a natural number equal to or greater than 2) nozzles 22, $2^n$ combinations of normal ejection and non-ejection of the n nozzles 22 are present. When the number of nozzles 22 ejecting liquid droplets is 3, the number of combinations of normal ejection and non-ejection is $2^3=8$, as shown in FIG. 7. In FIG. 7, when the ejections of three nozzles A, B, and C are normal, "1" is set. When non-ejection occurs, "0" is set.

Total amounts of liquid droplets ejected from three nozzles A, B, and C are different from each other in the eight combinations shown in FIG. 7. In FIG. 7, the amount of ink ejected from nozzle C is the minimum and is referred to as "a." The amount of ink ejected from nozzle B is assumed to be "2a" which is twice the amount of ink ejected from nozzle C. Further, the amount of ink ejected from nozzle A is assumed to be "4a" which is four times the amount of ink ejected from nozzle C. In the combinations, the amount of ink which is not ejected from the nozzle is 0 irrespective of the set amounts of ink ejected from the nozzles. In this case, as shown in the right column of FIG. 7, the total amounts of ink ejected from three nozzles A, B, and C, that is, the total ejection amounts; are different from each other in the eight combinations.

When the total amounts of liquid droplets ejected from three nozzles A, B, and C are different from each other in the eight combinations, a change in a temperature of ink in the manifold 25 also varies. Accordingly, based on the change in the temperature of the ink in the manifold 25 obtained when the control device 8 causes the inkjet head 4 to eject the liquid droplets from three nozzles A, B, and C, it is possible to differentiate states of nozzles A, B, and C among the eight combinations. That is, the nozzle(s) in which the non-ejection occurs can be specified among three nozzles A, B, and C.

Figure 8A:
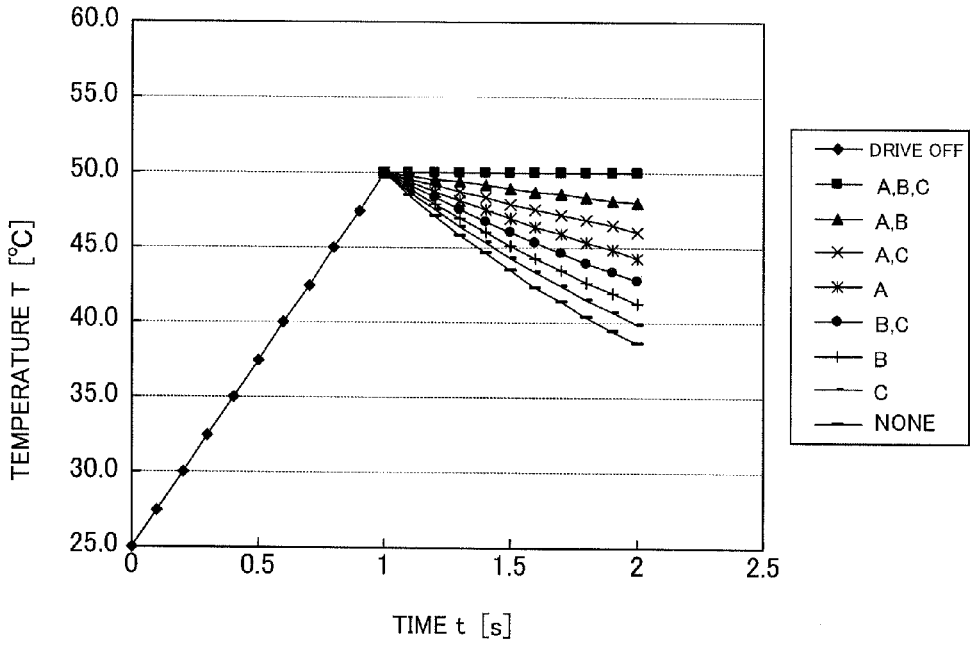
FIGS. 8A and 8B are graphs illustrating a specific example of a change in a temperature of ink in a manifold when amounts of ink ejected from three nozzles are set to be different.
Figure 8B:
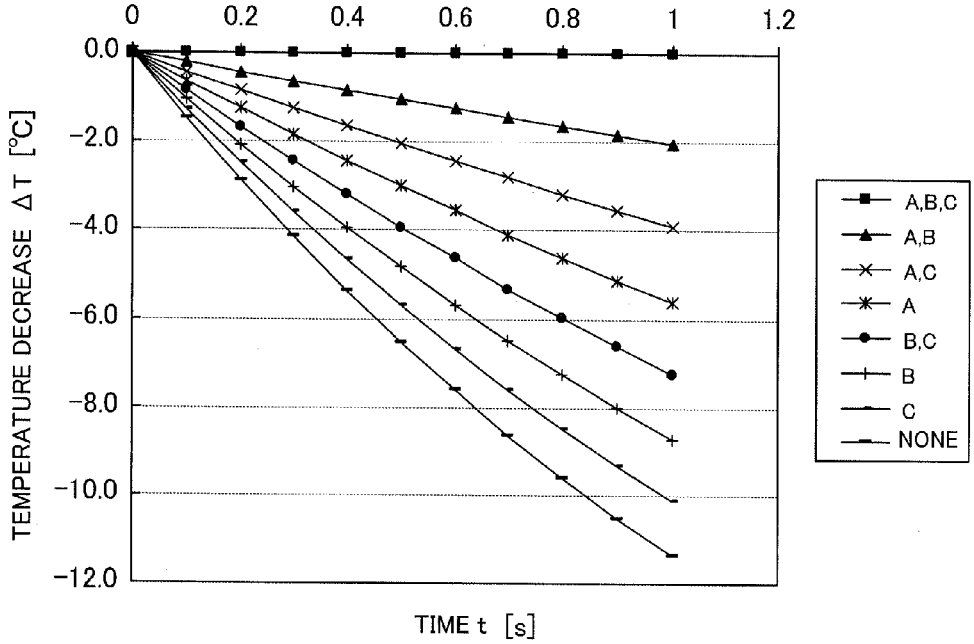

FIGS. 8A and 8B are graphs illustrating a specific example of a change in a temperature of ink in the manifold 25, when amounts of ink ejected from three nozzles A, B, and C are set to be different from each other. FIG. 8A shows a temporal change in the temperature of the ink in the manifold and FIG.

8B shows a temporal change in a temperature decrease ΔT from a target temperature. In this example, as shown in FIG. 8A, the heater 50 first heatsink in the manifold 25 for one second from 25° C. up to a target temperature 50° C. After the heating, the control device 8 causes the inkjet head 4 to eject liquid droplets from three nozzles A, B, and C for one second. Here, a ratio of the amounts of ink ejected from three nozzles A, B, and C is 4:2:1, as in FIG. 7. More specifically, the amount of ink ejected from nozzle A is 560,000 (pits), the amount of ink ejected from nozzle B is 280,000 (pl/s), and the amount of ink ejected from nozzle C is 140,000 (pl/s). In the explanatory notes of the graphs of FIGS. 8A and 8B, the nozzles in which non-ejection occurs are shown. For example, "A, B" represents that non-ejection occurs in nozzles A and B, and nozzle C is normal.

As shown in FIG. 8B, when the number of nozzles in which non-ejection occurs is large, or when non-ejection occurs in nozzle A configured to eject a large amount of ink, the temperature decrease ΔT from the target temperature Ts of the ink in the manifold 25 is less than. In particular, when non-ejection occurs in all nozzles A, B, and C, the change in the temperature of the ink from the target temperature Ts scarcely occurs. Thus, the temperature changes from the target temperature Ts are different from each other in the eight combinations. Accordingly, by comparing the temperature decreases ΔT to seven threshold values for differentiating the eight combinations, it is possible to differentiate states of nozzles A, B, and C among the eight combinations.

Further, by comparing the temperature decrease ΔT itself from the target temperature Ts to the threshold values, it may also be possible to differentiate states of nozzles A, B, and C among the eight combinations. Alternatively, when a difference in the temperature decreases ΔT is small in the eight combinations, it may also be possible to differentiate states of nozzles A, B, and C among the eight combinations, using integral values obtained by performing time integration on the temperature decreases ΔT for a predetermined ejection period (for example, one second) from the ejection start.

Since the total amounts of liquid droplets ejected from three nozzles A, B, and C are set to be different from each other in the eight combinations, an amount of a liquid droplet ejected from nozzle A, which is the maximum, is set to be larger than the total amount of liquid droplets ejected from two nozzles B and C. Such setting is applied when the number of nozzles is 3. To speak generally, when the control device 8 causes the inkjet head 4 to eject liquid droplets from a plurality of nozzles, an amount of ink ejected from a given nozzle 22 may be set to be greater than a total amount of ink ejected from other nozzles configured such that amounts of ink ejected from the other nozzles are less than the amount of ink ejected from the given nozzle 22, respectively.

The larger the difference in the temperature decreases ΔT is in the eight combinations, the less erroneous differentiation occurs. Thus, the detection accuracy is improved. Therefore, when the eight combinations are listed from the combination in which the total ejection amount is the smallest to the combination in which the total ejection amount is the largest, the differences between the total ejection amounts in the adjacent combinations are preferably substantially uniform. Specifically, when the amount of ink ejected from nozzle B is set to be twice the amount of ink ejected from nozzle C and the amount of ink ejected from nozzle A is set to be twice the amount of ink ejected from nozzle B, as shown in FIG. 7, the differences between the total ejection amounts are all a in the eight combinations.

To speak generally, when it is assumed that $V_1$ is an amount of ink ejected from a nozzle that ejects the smallest amount of ink and $V_m$ is an amount of ink ejected from a nozzle that ejects the $m^{th}$ smallest amount of ink, $V_m=2\times V_{m-1}=2^{m-1}\times V_1$ is satisfied. For example, when the control device 8 causes the inkjet head 4 to eject liquid droplets from five nozzles 22 and $V_1=a$ is set, $V_2=2a$, $V_3=4a$, $V_4=8a$, and $V_5=16a$ are obtained.

Figure 9:
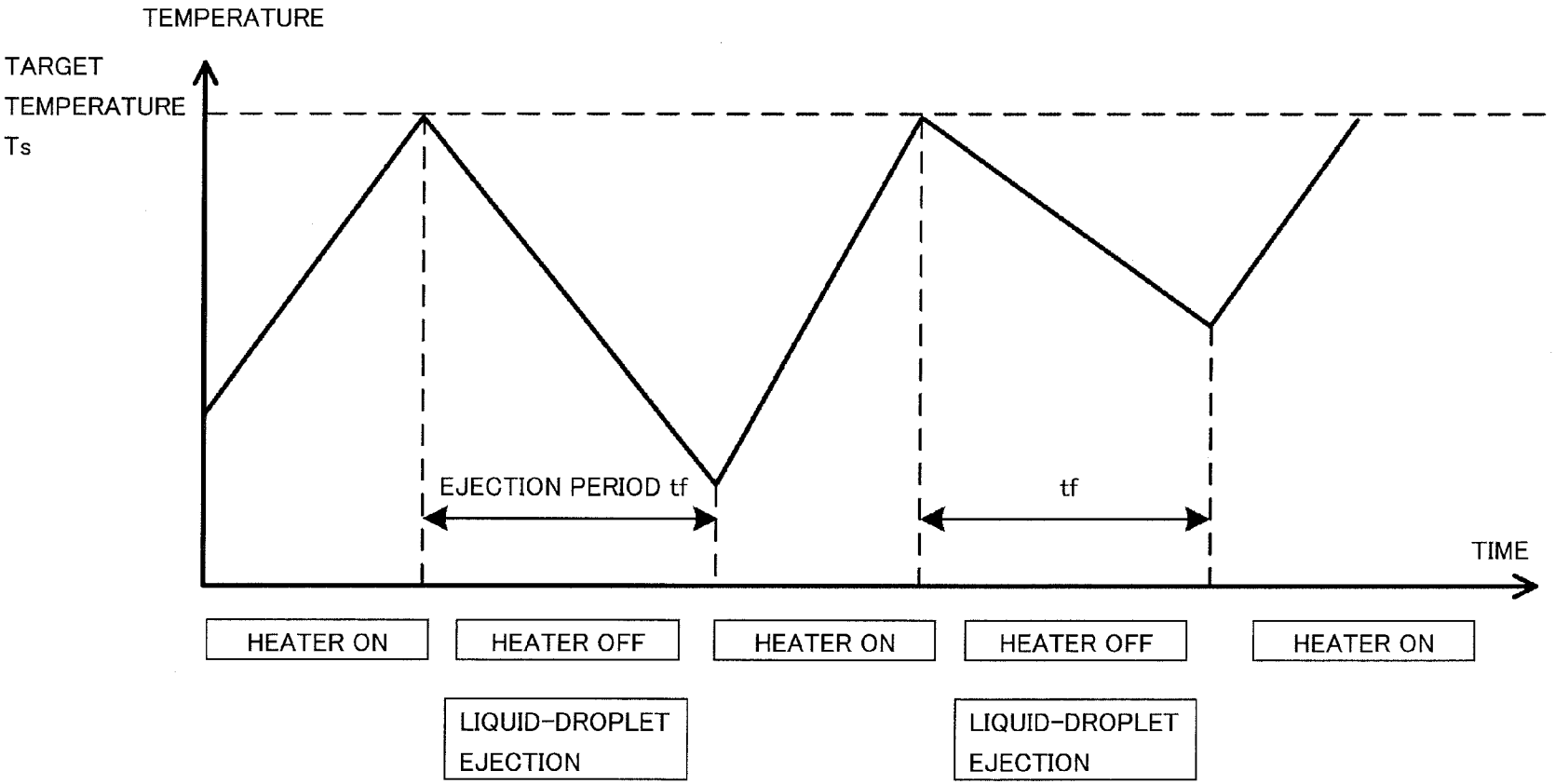
FIG. 9 is a diagram illustrating a temporal change in a temperature of ink in the manifold when non-ejection detection continues to be performed on a plurality of nozzles.

Referring back to FIG. 6, in S13, when the non-ejection detection on three nozzles A, B, and C ends, the non-ejection detection continues to be performed on the other nozzles 22 belonging to the same nozzle array 28. FIG. 9 is a diagram illustrating a temporal change in a temperature of ink in the manifold 25 when the non-ejection detection continues to be performed on the plurality of nozzles 22 belonging to the same nozzle array 28. In this embodiment, as shown in FIG. 9, the heater 50 heatsink in the manifold 25 up to the target temperature Ts, the heater 50 is turned off, and then the control device 8 causes the inkjet head 4 to eject liquid droplets from the nozzles 22. Therefore, the temperature of the ink in the manifold 25 decreases from the target temperature Ts during an ejection period tf in which the control device 8 causes the inkjet head 4 to eject the liquid droplets from the nozzles 22. Accordingly, when the non-ejection detection is performed on the next group of nozzles, the temperature of the ink in the manifold 25 is less than the target temperature Ts. Thus, the operation returns to S10 and the heater 50 heats the ink in the manifold 25 up to the target temperature Ts.

That is, as shown in FIG. 9, the highest temperature of the ink in the manifold 25 is the target temperature Ts during the examination of all the nozzles 22 and the temperature of the ink does not exceed the target temperature Ts. Therefore, it is not necessary to increase a temperature of ink to a high temperature, it is not necessary to use the high-output heater 50, and thus energy loss is also small. Further, the target temperature Ts can be set to be constant when the examination of all the nozzles 22 starts. Therefore, one kind of seven threshold values may be set to distinguish the eight combinations of the normal ejection and the non-ejection.

When a temperature of ink supplied from the ink cartridge 17 to the inkjet head 4 is high, a difference between a target temperature Ts of the ink in the manifold 25 when the non-ejection is detected and a temperature of the ink supplied from the upstream side becomes small, and thus a temperature decrease ΔT also decreases when the ink is normally ejected. For this reason, the detection accuracy of the non-ejection may deteriorate. Accordingly, a target temperature Ts may be changed in accordance with a temperature of supplied ink. For example, since a temperature of ink supplied from the ink cartridge 17 to the inkjet head 4 is substantially the same as an ambient temperature, a target temperature Ts can be changed in accordance with an ambient temperature detected by the ambient-temperature sensor 53 (see FIG. 5). Alternatively, a dedicated temperature sensor that detects a temperature of ink may be mounted in an ink supply passage extending from the ink cartridge 17 to the inkjet head 4.

When the operation of detecting whether the non-ejection occurs in all of the nozzles 22 of one nozzle array 28 ends (Yes in S14), the non-ejection detection ends. As shown in FIG. 2, the inkjet head 4 according to this embodiment includes five nozzle arrays 28. The five nozzle arrays 28 may be examined in sequence. Alternatively, the five nozzle arrays 28 may be examined simultaneously in parallel. When the five nozzle arrays 28 are simultaneously examined, it is necessary to simultaneously heat ink in the five manifolds 25 up to a target temperature. Accordingly, the five heaters 50 arranged respectively in the five manifolds 25 may be connected to each other and the five heaters 50 may be driven by one heater drive circuit 52. In this case, it is possible to reduce the number of heater drive circuits 52 and reduce the number of wirings for the heaters 50.

When it is detected that the non-ejection occurs in a given nozzle 22 in the above-described examination, a recovery operation of resolving the non-ejection of the nozzle 22 is performed. Specifically, the purge mechanism 6 performs the suction purging to resolve the non-ejection of the nozzle 22. Further, since the nozzle 22 in which the non-ejection occurs is specified, the non-ejection may be resolved by performing flushing on only the nozzle 22.

In a case where liquid droplets are almost simultaneously ejected from two nozzles 22 located close to each other, a so-called crosstalk phenomenon may occur in that vibration or the like occurring in the flow passage when the liquid droplet is ejected from one nozzle 22 may have an influence on the ejection of the other nozzle 22. In particular, the influence of the crosstalk is considerable, since the piezoelectric actuator 21 according to this embodiment has the configuration in which the plurality of pressure chambers 24 are covered with the common vibration plate 30 and the piezoelectric layer 31. That is, the deformation of the vibration plate 30 and the piezoelectric layer 31 in one pressure chamber 24 is propagated to the adjacent other pressure chamber 24, and thus has an influence on a pressure of ink in the other pressure chamber 24. In this case, even when a liquid droplet is normally ejected from the nozzle 22 communicating the other pressure chamber 24, an amount of an actually ejected liquid droplet may deviate from a set value. Thus, there is a concern that the operation of differentiating states of nozzles among the eight combinations may be erroneously performed.

Accordingly, it is preferred that the control device 8 does not cause the inkjet head 4 to eject liquid droplets simultaneously from a combination of the nozzles 22 in which the crosstalk easily occurs when the control device 8 causes the inkjet head 4 to eject liquid droplets in S11 of FIG. 6. Specifically, the control device 8 does not cause the inkjet head 4 to eject liquid droplets simultaneously from two adjacent nozzles 22 in one nozzle array 28. As shown in FIG. 2, the two nozzle arrays 28*k*1 and 28*k*2 for black ink are disposed in parallel. The control device 8 does not cause the inkjet head 4 to eject liquid droplets simultaneously from two nozzles 22 disposed in the adjacent nozzle arrays 28*k*1 and 28*k*2 and located in proximity to each other, a distance of the two nozzles 22 being the minimum. In other words, the control device 8 does not cause the inkjet head 4 to eject liquid droplets simultaneously from two nozzles 22 for which the pressure chambers 24 are adjacent to each other in either one nozzle array 28 or two nozzle arrays 28. Here, the term "simultaneously" includes not only a case in which application timings of drive signals are substantially identical but also a case in which application timings of drive signals are slightly deviated from each other but periods in which the deformation of the vibration plate or the like after the application remains overlap.

Figure 10A:
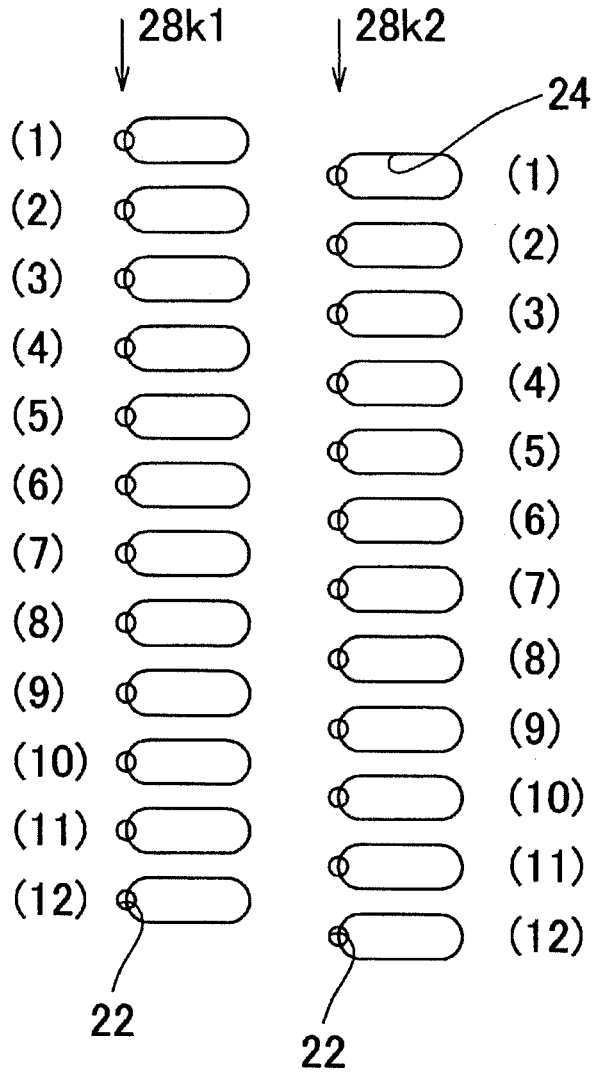

FIGS. 10A and 10B are diagrams illustrating a specific example of an ejection order of the plurality of nozzles 22 constituting the nozzle array 28. FIG. 10A shows the two nozzle arrays 28*k*1 and 28*k*2 configured to eject black ink. In FIG. 10A, numerals such as "(1)" written next to the nozzle arrays 28*k*1 and 28*k*2 are numerals given to the nozzles to facilitate the description. FIG. 10B shows the ejection order of the nozzles 22 in each nozzle array 28 when the non-ejection detection is performed simultaneously on the two nozzle arrays 28*k*1 and 28*k*2. First, three nozzles 22 located at every other position in the conveyance direction in each of the nozzle arrays 28*k*1 and 28*k*2 are grouped and the non-ejection detection is performed in each group of three nozzles 22. For example, the non-ejection detection is simultaneously performed by causing the inkjet head 4 to eject liquid droplets for the same period from three nozzles of No. 1, No. 3, and No. 5 in the left nozzle array 28*k*1 by the control device 8. According to the ejection order, liquid droplets are not ejected simultaneously from two nozzles 22 adjacent to each other in each nozzle array 28.

The following operation is performed when the non-ejection detection is performed simultaneously in the left nozzle array 28*k*1 and the right nozzle array 28*k*2. To suppress the influence of the crosstalk on the two nozzle arrays 28*k*1 and 28*k*2 as much as possible, three nozzles 22 of the left nozzle array 28*k*1 and three nozzles 22 of the right nozzle array 28*k*2 ejecting liquid droplets at the same timing are distant from each other in the conveyance direction. For example, as shown in FIG. 10A, when the control device 8 causes the inkjet head 4 to eject liquid droplets from the three nozzles of No. 1, No. 3, and No. 5 located on the upper side of FIG. 10A in the left nozzle array 28*k*1, the control device 8 causes the inkjet head 4 to eject liquid droplets from three nozzles of No. 7, No. 9, and No. 11 located on the lower side of FIG. 10A in the right nozzle array 28*k*2. Conversely, when the control device 8 causes the inkjet head 4 to eject liquid droplets from the three nozzles of No. 7, No. 9, and No. 11 located on the lower side of FIG. 10A in the left nozzle array 28*k*1, the control device 8 causes the inkjet head 4 to eject liquid droplets from three nozzles 22 of No. 1, No. 3, and No. 5 located on the upper side of FIG. 10A in the right nozzle array 28*k*2.

According to such an ejection order, liquid droplets are not ejected simultaneously from two nozzles 22 disposed in the two nozzle arrays 28*k*1 and 28*k*2 and located most closely. For example, the nozzles of the right nozzle array 28*k*2 which is the nearest to nozzle No. 4 of the left nozzle array 28*k*1 are two nozzles of No. 3 and No. 4. However, as understood from FIG. 10B, the nozzles ejecting liquid droplets simultaneously with nozzle No. 4 of the left nozzle array 28*k*1 in the fourth ejection order are three nozzles of No. 8, No. 10, and No. 12 of the right nozzle array 28*k*2. Accordingly, liquid droplets are not ejected simultaneously from nozzle No. 4 of the left nozzle array 28*k*1 and two nozzles of No. 3 and No. 4 of the right nozzle array 28*k*2.

In the inkjet printer 1 according to the above-described embodiment, the heater 50 heatsink in the manifold 25, and then the temperature sensor 51 detects a temperature of the ink in the manifold 25 when the control device 8 causes the inkjet head 4 to eject a liquid droplet from the nozzle 22. Thus, it is possible to detect whether the non-ejection occurs in the nozzle 22 having ejected the liquid droplet. Further, the heater 50 and the temperature sensor 51 are arranged in the manifold 25 with which the plurality of individual flow passages 27 each including the nozzle 22 commonly communicate. Therefore, the number of heaters 50 and the number of temperature sensors 51 are smaller, and the wirings can be easily drawn, compared to the configuration in which the heater 50 and the temperature sensor 51 are arranged in each of the plurality of individual flow passages 27

In this embodiment, the heater 50 heatsink, and then the temperature sensor 51 detects a temperature of the ink in the manifold 25 when the control device 8 causes the inkjet head 4 to eject liquid droplets from two or more nozzles 22. In this case, since an amount of consumed ink is greater than an amount of a liquid droplet ejected from only one nozzle 22, a change in the temperature of the ink in the manifold 25 increases. Accordingly, the accuracy of the non-ejection detection is improved. Further, by setting amounts of ink ejected from two or more nozzles 22 to be different from each other, it is possible to determine in which nozzle 22 the non-ejection occurs among the two or more nozzles 22.

The inkjet printer 1 according to this embodiment corresponds to a "liquid-droplet ejection device" of the claims. The inkjet head 4 according to this embodiment corresponds to a "liquid-droplet ejection head" of the claims. The ink supply hole 26 and the manifold 25 communicating with the ink supply hole 26 according to this embodiment correspond to a "common flow passage" of the claims.

In this embodiment, the control device 8 corresponds to a "control section" of the claims. Moreover, the control device 8 performing the non-ejection detection in S10 to S14 of FIG. 6 using the heater 50 and the temperature sensor 51 corresponds to the "control section" of the claims.

Next, various modifications of the above-described embodiment will be described. The same reference numerals are given to constituent elements having the same configuration as the configuration described above, and the description thereof will appropriately not be repeated.

1] As long as arrangement positions at which the heater 50 and the temperature sensor 51 are arranged are within the flow passage with which the plurality of individual flow passages 27 commonly communicate, the arrangement positions of the heater 50 and the temperature sensor 51 are not limited to specific positions. For example, the heater 50 and the temperature sensor 51 may be arranged in the ink supply hole 26 located on the upstream side from the manifold 25 in FIGS. 2 and 3. However, when the heater 50 is arranged at a position at which an area of the flow passage is small, a temperature of ink heated by the heater 50 can increase for a short time. Further, since a flow rate of ink increases at the position at which the area of the flow passage is small, it is easy for the control device 8 to detect a change in a temperature of the ink based on the temperature detected by the temperature sensor 51. Accordingly, it is preferred that the heater 50 and the temperature sensor 51 are arranged particularly at a position at which an area of a flow passage is small in the common flow passage formed by the manifold 25 and the ink supply hole 26.

For example, as shown in FIG. 2, two manifolds 25*k*1 and 25*k*2 are diverged from one ink supply hole 26*k* in a black ink supply system. In the configuration of the common flow passage, it is preferred that the heater 50 and the temperature sensor 51 are arranged in the manifolds 25*k*1 and 25*k*2 of which the area of the flow passage is smaller than that of the ink supply hole 26, as in the above-described embodiment.

The heater 50 and the temperature sensor 51 may be arranged in a halfway portion of the manifold 25 or an end portion of the manifold 25 on the downstream side. However, when the temperature sensor 51 is located in the manifold 25 on the downstream side from communication portions of a part of the pressure chambers 24 with the manifold 25, it is difficult for the control device 8 to detect a change in a temperature of ink in the manifold 25 based on the temperature of the ink in the manifold 25 detected by the temperature sensor 51, when liquid droplets are ejected from the nozzles 22 corresponding to the part of the pressure chambers 24. From this viewpoint, as shown in FIGS. 2 and 3, it is preferred that the heater 50 and the temperature sensor 51 are arranged on the upstream side from the communication portions of all the pressure chambers 24 with the manifold 25.

2] In the above-described embodiment, the case in which the control device 8 causes the inkjet head 4 to eject liquid droplets from two or more nozzles 22 and the non-ejection of the two or more nozzles 22 is detected has been described. However, the control device 8 may cause the inkjet head 4 to eject a liquid droplet from only one nozzle 22 to detect the non-ejection for each nozzle 22. In this case, since ink is ejected from only one nozzle 22, an amount of ink ejected from the one nozzle 22 is smaller, compared to the above-described embodiment. Accordingly, it is preferred that an amount of a liquid droplet is devised to increase. For example, the volume of a liquid droplet per ejection may increase or the number of times liquid droplets are ejected may increase.

When the nozzles 22 are examined one by one, not only the non-ejection state can be detected as the abnormal ejection of the nozzle 22, but a defective ejection state in which an amount of ink ejected from one nozzle 22 is smaller than an amount of ink ejected from one nozzle 22 normally can also be detected as the abnormal ejection of the nozzle 22. That is, in the defective ejection state in which an amount of ejected ink is small, the amount of consumed ink is larger than that in the non-ejection state. However, the amount of consumed ink is smaller than that in the normal ejection state. Accordingly, a change in a temperature of ink detected by the control device 8 is different in three states of the normal ejection, the defective ejection, and the non-ejection. Thus, the three states can be distinctively detected based on a detection result of the control device 8.

However, when the control device 8 causes the inkjet head 4 to eject liquid droplets from two or more nozzles 22, it is difficult to determine the defective ejection state, as in the above-described embodiment. That is, using only a change in a temperature of ink detected by the control device 8, it is difficult to distinguish a defective ejection state in which amounts of liquid droplets ejected from both of two nozzles 22 are small, and a non-ejection state in which a liquid droplet is normally ejected from one of two nozzles 22 and a liquid droplet is not ejected from the other nozzle 22. Accordingly, it is possible to detect an intermediate state which is the "defective ejection" state between the normal ejection state and the non-ejection state when a liquid droplet is ejected from one nozzle 22.

3] In the above-described embodiment, the heater 50 heats ink and the control device 8 causes the inkjet head 4 to eject liquid droplets from the nozzles 22 after the heating has been stopped. However, while the heater 50 heatsink, the control device 8 may cause the inkjet head 4 to eject liquid droplets from the nozzles 22. Thus, when the control device 8 causes the inkjet head 4 to eject ink during the heating of the ink in the manifold 25, a temperature of the ink gently increases in the normal ejection state. However, when the abnormal ejection such as non-ejection occurs, a temperature of the ink sharply increases. Accordingly, the control device 8 detects whether abnormal ejection occurs based on a degree of an increase in a temperature of ink.

When examination of a given nozzle 22 ends, a temperature of liquid in the manifold 25 is generally equal to or higher than a temperature of liquid at the start of the examination. Therefore, as the plurality of nozzles 22 are examined in sequence to detect whether the abnormal ejection occurs, the temperature of the liquid in the manifold 25 continues to increase. Accordingly, since it is necessary to provide a cooling period in order to decrease the temperature, it is difficult to examine the plurality of nozzles 22 in succession to detect whether the abnormal ejection occurs. Further, since the target temperatures are different from each other at the start of examining each nozzle 22, it is necessary to set a threshold of a temperature for detecting abnormal ejection of each nozzle 22. As described above, the abnormal ejection can be detected by causing the inkjet head 4 to eject liquid droplets from the nozzles 22 during the heating of ink. However, in consideration of the above-described viewpoint, it is preferred that the control device 8 causes the inkjet head 4 to eject liquid droplets from the nozzles 22 after the heating of ink is stopped, as in the above-described embodiment.

The embodiment and the modifications described above are applied to an inkjet printer which is a kind of liquid-droplet ejection device. However, an application target is not limited to the inkjet printer. For example, the embodiment and the modifications are applicable to liquid-droplet ejection devices used in other fields, such as a device that forms various conductive patterns by ejecting a liquid conductive material to a substrate.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A liquid-droplet ejection device comprising:

a liquid-droplet ejection head comprising:

a plurality of individual flow passages each provided with a nozzle; and a common flow passage commonly communicating with the plurality of individual flow passages;

a heater provided in the common flow passage, wherein the heater is configured to be controlled to heat a liquid in the common flow passage;

a temperature sensor provided in the common flow passage and on an upstream side in a direction in which the liquid flows from a communication portion in which the plurality of individual flow passages communicates with the common flow passage, wherein the temperature sensor is configured to be controlled to detect a temperature of the liquid in the common flow passage; and a control section configured to:

control the heater to heat the liquid in the common flow passage to a target temperature, control predetermined nozzles of the plurality of nozzles of the liquid-droplet ejection head to eject one or more liquid droplets in a predetermined time period, wherein an amount of liquid to be ejected from each of the predetermined nozzles is controlled to be mutually different such that a total amount of the liquid to be ejected from the predetermined nozzles in the predetermined time period is a unique value corresponding to a unique combination of the predetermined nozzles that ejects the liquid in the predetermined time period, and wherein the unique value of the total amount of the liquid to be ejected in the predetermined time period corresponds to a unique value of decrease in temperature of the liquid detected by the temperature sensor, control the temperature sensor to detect a post-ejection temperature of the liquid after the predetermined time period, and determine a measured value of decrease in temperature of the liquid based on a difference between the target temperature and the post-ejection temperature, and compare the measured value of decrease in temperature to the unique value of decrease in temperature to determine for each nozzle of the predetermined nozzles whether ejection of the liquid occurred in the predetermined time period.

2. The liquid-droplet ejection device according to claim 1, wherein the liquid-droplet ejection head comprises a nozzle array in which the plurality of nozzles are arranged in a predetermined direction, and wherein when the control section detects a change in a temperature of the liquid in the common flow passage, the control section causes the liquid-droplet ejection head to simultaneously eject liquid droplets from at least two nozzles which are not adjacent to one another in the predetermined direction in the nozzle array.

3. The liquid-droplet ejection device according to claim 2, wherein the liquid-droplet ejection head comprises a plurality of the nozzle arrays parallel to each other, and wherein when the control section detects a change in a temperature of the liquid in the common flow passage, the control section causes the liquid-droplet ejection head to simultaneously eject liquid droplets from nozzles which are arranged in two nozzle arrays adjacent to each other, respectively, a distance of the nozzles arranged in the two nozzle arrays respectively being not minimum among distances of the nozzles arranged in the two nozzle arrays respectively.

4. The liquid-droplet ejection device according to claim 1, further comprising an ambient-temperature sensor configured to detect an ambient temperature, wherein the target temperature is set in accordance with the ambient temperature detected by the ambient-temperature sensor.

5. The liquid-droplet ejection device according to claim 1, wherein the heater is provided on the upstream side in the direction in which liquid, flows from the communication portion.

* * * * *